US006363660B1

(12) United States Patent
Saelzer

(10) Patent No.: US 6,363,660 B1
(45) Date of Patent: Apr. 2, 2002

(54) BULLET-IMPEDING OR BURGLARY-INHIBITING SECURITY WINDOW OR DOOR

(75) Inventor: Heinrich Saelzer, Marburg (DE)

(73) Assignee: Saelzer Sicherheitstechnik GmbH, Marburg (DE)

( * ) Notice: Subject to any disclaimer, the term of this patent is extended or adjusted under 35 U.S.C. 154(b) by 0 days.

(21) Appl. No.: 09/576,603

(22) Filed: May 25, 2000

(30) Foreign Application Priority Data

May 26, 1999 (DE) ..... 199 23 922

(51) Int. Cl.[7] ..... E06B 5/11
(52) U.S. Cl. ..... 49/401; 52/204.1; 52/204.5
(58) Field of Search ..... 49/501, 504, DIG. 1, 49/400, 401; 52/171.1, 210, 204.1, 204.51, 207, 204.5, 656.2, 656.4, 656.5, 656.6; 109/58.5, 64, 74

(56) References Cited

U.S. PATENT DOCUMENTS

| | | | | |
|---|---|---|---|---|
| 3,072,229 A | * | 1/1963 | Pasche et al. | 49/401 |
| 4,513,552 A | * | 4/1985 | Breithaupt | 49/DIG. 1 |
| 4,581,852 A | * | 4/1986 | Jager et al. | 49/401 |
| 4,625,659 A | | 12/1986 | Saelzer | |
| 4,640,054 A | * | 2/1987 | Breimeier et al. | 49/504 |
| 4,773,682 A | | 9/1988 | Saelzer | |
| 4,962,710 A | * | 10/1990 | Habicht et al. | 52/204.5 |

FOREIGN PATENT DOCUMENTS

| | | | |
|---|---|---|---|
| DE | 2028129 | * 12/1970 | 49/401 |
| DE | 7803666 | 5/1978 | |
| DE | 2845951 | 4/1980 | |
| DE | 3604433 | 10/1987 | |
| EP | 0253983 | 1/1988 | |

* cited by examiner

*Primary Examiner*—Michael Safavi
(74) *Attorney, Agent, or Firm*—W. F. Fasse; W. G. Fasse

(57) ABSTRACT

A security window or security door that impedes forced entry or penetration by projectiles includes a jamb frame (2) and a panel frame (3) that is pivotably mounted in the jamb frame. The jamb frame and the panel frame are constructed from hollow profile members (5, 6, 8, 9) having hollow chambers (17, 18) extending longitudinally therein and including solid edge portions (14, 15). The solid edge portion (14) of the jamb frame (2) overlaps the solid edge portion (15) of the panel frame (3) in an overlap area (25) when the door or window is closed, while leaving a convoluted or non-linear gap (16) between the jamb frame and the panel frame through the overlap area. Inserts (23, 24) that help impede forced entry and/or bullet penetration can optionally be disposed in the respective hollow chambers, to easily adapt the degree of security provided by the door or window to the security requirements of any particular situation. The hollow chambers (17, 18) in the respective profile members do not extend into the overlap area (25). Instead, the solid edge portions (14, 15) are directly adjacent to the hollow chambers in the overlap area. Thereby, the fabrication of the profile members is simplified and the security is improved.

24 Claims, 4 Drawing Sheets

BULLET-IMPEDING OR BURGLARY-INHIBITING SECURITY WINDOW OR DOOR

PRIORITY CLAIM

This application is based on and claims the priority under 35 U.S.C. §119 of German Patent Application 199 23 922.3, filed on May 26, 1999, the entire disclosure of which is incorporated herein by reference.

FIELD OF THE INVENTION

The invention relates to a security window or security door that impedes the penetration of bullets or other projectiles and inhibits forceful entry or burglary. The security window or door includes a window or door jamb frame and a window or door panel frame that is pivotably mounted in the jamb frame. Edge portions of the jamb frame overlap edge portions of the panel frame in an overlap area. The jamb frame and the panel frame are embodied as hollow profile members having hollow chambers that extend in the longitudinal direction therein. Burglary-inhibiting and/or bullet-impeding inserts can be disposed in these hollow chambers.

BACKGROUND INFORMATION

German Patent Publication DE 36 04 433 C1 discloses a security window or door having a hollow chamber in the hollow profile of the window or door panel frame. The hollow chamber can receive a bullet-impeding insert therein and extends along a comparatively recessed or set back plane in the hollow profile in the area of a gap that is formed between the window or door panel frame and the jamb frame. The purpose of the recessed insert is to prevent projectiles from penetrating through the window or door directly in the area of the gap. Furthermore, the disclosed window or door can be provided with an additional insert both in the jamb frame and in the window or door panel frame, whereby the additional insert is arranged in front of the above mentioned insert that protects the gap area (viewing the window or door from the side that is subject to forceful attack). As a result, the profile allocated to the panel frame overlaps, on the one side, an edge portion of a bullet-impeding filler panel and, on the other side, an edge portion of the recessed insert, also in the window or door panel frame. An edge area of the insert in the jamb frame also overlaps on the one side the recessed insert of the window or door panel frame and, on the other side, for example, an additional insert of the jamb frame that is also recessed and that can form the connection to other structural parts of the building.

The security window or door described above provides overall a bullet-impeding embodiment of the frame construction. While the known construction has proven to be technically very useful, it suffers the disadvantage that the production of the security profiles is relatively complex and thus relatively expensive. The complexity stems from the fact that the profile of the window or door panel frame is provided with two hollow chambers arranged offset from each other for receiving inserts. Also, the embodiment and arrangement of the inserts in the overlap or rabbeted area, in which the gap between the window or door panel frame and the window or door jamb frame changes its direction a number of times, is particularly complicated.

Another construction of a window, door, or fixed glass panel in a bullet-impeding embodiment is disclosed in European Patent Publication 0,253,983 B1. Here, too, security profiles that overlap each other in an overlap area are provided on the attack-prone side of both the window or door jamb frame and the panel frame. The gap formed between the two profiles has the form of two waves cutting across each other and extends at approximately a 45° angle relative to the plane of the window. The profiles of both the window or door jamb frame and the window or door panel frame are provided with trapezoidal-shaped hollow chambers that also extend at an angle of approximately 45°. Insert panels that extend either parallel or perpendicular to the longitudinal direction of the hollow chambers are arranged in the hollow chambers. The hollow chambers extend into the overlap area to ensure that security against penetration by a projectile is also provided in the overlap area of the two profiles. This is one of the features that make this particular known construction complicated to manufacture. German Patent Publication DE 78 03 666 U1 discloses a bullet-impeding door or window construction of the general type described above. The inserts in the profiles of the window or door panel frame and the jamb frame are arranged in two planes that extend parallel yet offset relative to each other. These inserts extend into the overlap area of the two profiles, which are separated from each other by a stepped gap. It is comparatively simple to manufacture such security profiles. Such profiles, however, are not adequate to satisfy the security requirements if, in addition to a bullet-impeding effect, a forced entry inhibiting effect is also required, particularly in the higher resistance or security classes.

German Patent Publication DE 28 45 951 C2 discloses a bullet-impeding metal door. The outer side of the profiles for both the jamb frame and the window or door panel frame is provided with a solid, massive casing or cover profile that is to prevent projectiles from penetrating through the frame area. The gap between the jamb frame and the panel frame in the area of the solid cover profile extends diagonally relative to the plane of the window or door and is, in addition, bent in an S-shape. Such a construction is disadvantageous if a bullet-impeding effect of the window or the door is not required and the requirements for protecting against forceful entry are low (lower resistance or security classes). In this case, the solid embodiment of the cover profiles is unnecessarily expensive and furthermore results in a noticeable increase in weight of the jamb frame and/or panel frame construction.

SUMMARY OF THE INVENTION

In view of the above, it is an object of the invention to provide a security window or a security door, generally called a security structure herein, that is less costly to manufacture, and that is adaptable through simple measures to satisfy the requirements for the various resistance or security classes with respect to preventing forceful entry or penetration by a bullet or other projectile without requiring modifications of the basic frame profile members of the security structure. The invention further aims to avoid or overcome the disadvantages of the prior art and to achieve additional advantages, as are apparent from the present specification.

The above objects have been achieved according to the invention in a security structure, e.g., a security window or security door, in which hollow jamb frame and/or panel frame profile members have therein hollow chambers that are situated exclusively laterally next to or displaced from an overlap area of the jamb frame and the panel frame. The hollow profile member of the jamb frame and/or of the window or door panel frame includes a solid edge portion in the overlap area. The respective hollow chamber is directly adjacent to the respective edge portion. Because of the solid construction of the edge portions in the overlap area, it is not necessary to provide hollow chambers in that area. This is an advantage because it was often technically difficult to manufacture hollow chambers in the irregularly-shaped overlap area. In any case, the conventional construction of the hollow chambers in the overlap area added significantly to the manufacturing costs. Also, because the solid portion of the profile members of the jamb frame and the panel frame is restricted to a relatively small edge portion in the overlap area, the material requirements for such profile members are held within limits, which further aids in keeping costs down. Furthermore, the weight per unit length of the profile member having a solid edge portion is increased only slightly by the solid edge portion, in contrast to a conventional construction in which the outer profile member of the security door or window is constructed as a solid profile member.

The core concept of the invention is to protect the overlap area, which is typically formed to have an irregular shape by a number of stepped surfaces or recesses, by providing a solid, massive edge portion on the profile member and providing a hollow chamber that is directly adjacent to the edge portion. The edge portions are relatively simple to produce and the hollow chambers can receive break-in inhibiting and/or bullet-impeding security inserts. This construction protects the overlap or rabbeted area, without requiring a solid window or door construction that would be unnecessarily heavy and expensive to manufacture. Thus, the security window or door according to the invention provides the required security, yet simultaneously avoids unnecessary weight and expense.

The profile members for the jamb frame and the window or door panel frame remain unchanged, regardless of the security requirements that must be satisfied. Thus, the invention provides a tremendous advantage because the basic security window or door according to the invention, with its solid edge portions and hollow chambers, as a basic minimum satisfies the requirements of the lower resistance classes with regard to inhibiting forced entry, yet can easily be adapted or upgraded as desired to meet the requirements of higher resistance classes simply by arranging appropriate security inserts in the hollow chambers. The particular security demands will determine which type of material is appropriate for use as the insert material, for example, aluminum, steel, hard metal, or ceramic. The solid edge portions in the overlap area of the jamb frame and panel frame profile members provide a basic protection against penetration by a bullet or other projectile. The protection against penetration of the window or door by a bullet or projectile can be adapted to meet the demands of the highest resistance classes by appropriately adapting the thickness or strength of the edge portions.

The "basic profile" of the security window or door according to the invention also provides a basic protection against burglary or breaking and entering (generally any forced entry), because the solid edge portions operate to prevent the security door or window from being pried open in the overlap or rabbeted area. The burglary-inhibiting protection can be increased to meet any security demand by arranging security inserts in the hollow chambers. The solid edge portions in the overlap area also provide the possibility, when embodied with the appropriate cross-section, of causing the jamb frame and the panel frame to catch or interlock with each other if a person tries to break open the window or door.

The security window or door according to the invention thus provides a certain minimum degree of protection against forced entry and penetration by projectiles in any case, and can provide increased burglary-inhibiting and/or bullet-impeding protection according to a building block principle by incorporating readily available additional standard components, particularly security inserts. The use of the appropriate inserts makes it possible to adapt the security door or window to meet the security requirements of the highest resistance or security classes.

In a particularly advantageous embodiment of the invention, the respective hollow profile member and the solid edge portion are integrally constructed as a single piece. This construction eliminates the need for possibly complicated attachment or bonding measures. Also, such an integral profile member can easily be fabricated by known techniques such as extrusion.

In a further embodiment of the invention, the gap that is formed between the jamb frame and the panel frame extends initially at a right angle to the plane of the window or door, then parallel to the plane of the window or door, and finally, extends again at a right angle or obliquely relative to the plane of the window or door. This embodiment of the gap area is a particularly effective impediment to penetration by a bullet or other projectile because it prevents a projectile from penetrating through the entire depth or thickness of a profile member along a straight "alley" or path through the gap. A projectile that coincidentally penetrates precisely into the gap opening from the attack side will quickly lose much of its energy because of the forced change of direction caused by the angling of the gap and, as a result, will not be able to penetrate entirely through the profile member.

According to another embodiment of the invention, the hollow profile members of the jamb frame and/or the panel frame each respectively have therein two hollow chambers arranged one behind the other in a direction perpendicular to the plane of the window or door. The hollow chamber closest to the attack side is provided with a single-layer or multilayer insert arranged therein. Thus, the insert arranged in the hollow chamber on the attack side can be securely fixed. Furthermore, this insert can be constructed to be relatively narrow or thin, yet, depending on the material of the insert, still satisfy the highest requirements for impeding penetration by a bullet or other projectile. The overall amount of material required for the profile members according to the invention is also reduced because the rear hollow chamber, which is arranged behind the forward hollow chamber filled with the insert, remains hollow. This also aids in avoiding excessive weight of the security window or door.

In an alternative embodiment, the jamb frame and/or the panel frame each comprise two hollow profile members that are connected to each other by a thermal insulation profile member. This thermal insulation profile member can be made of any conventionally known synthetic material having thermal insulating qualities, for example. Thus, despite the metal profile members that are used on the outside and inside because of their strength and break-in resistance ability, the thermal insulation profile members inserted between the two metal profile members will ensure that the security window or door provides good thermal insulation, because the insulating material provides a break or barrier in the thermal conduction path through the frame.

BRIEF DESCRIPTION OF THE DRAWINGS

In order that the invention may be clearly understood, it will now be described in connection with example embodiments, with reference to the accompanying drawings, wherein.

DESCRIPTION OF PREFERRED EXAMPLE EMBODIMENTS AND OF THE BEST MODE OF THE INVENTION

Figure 1:
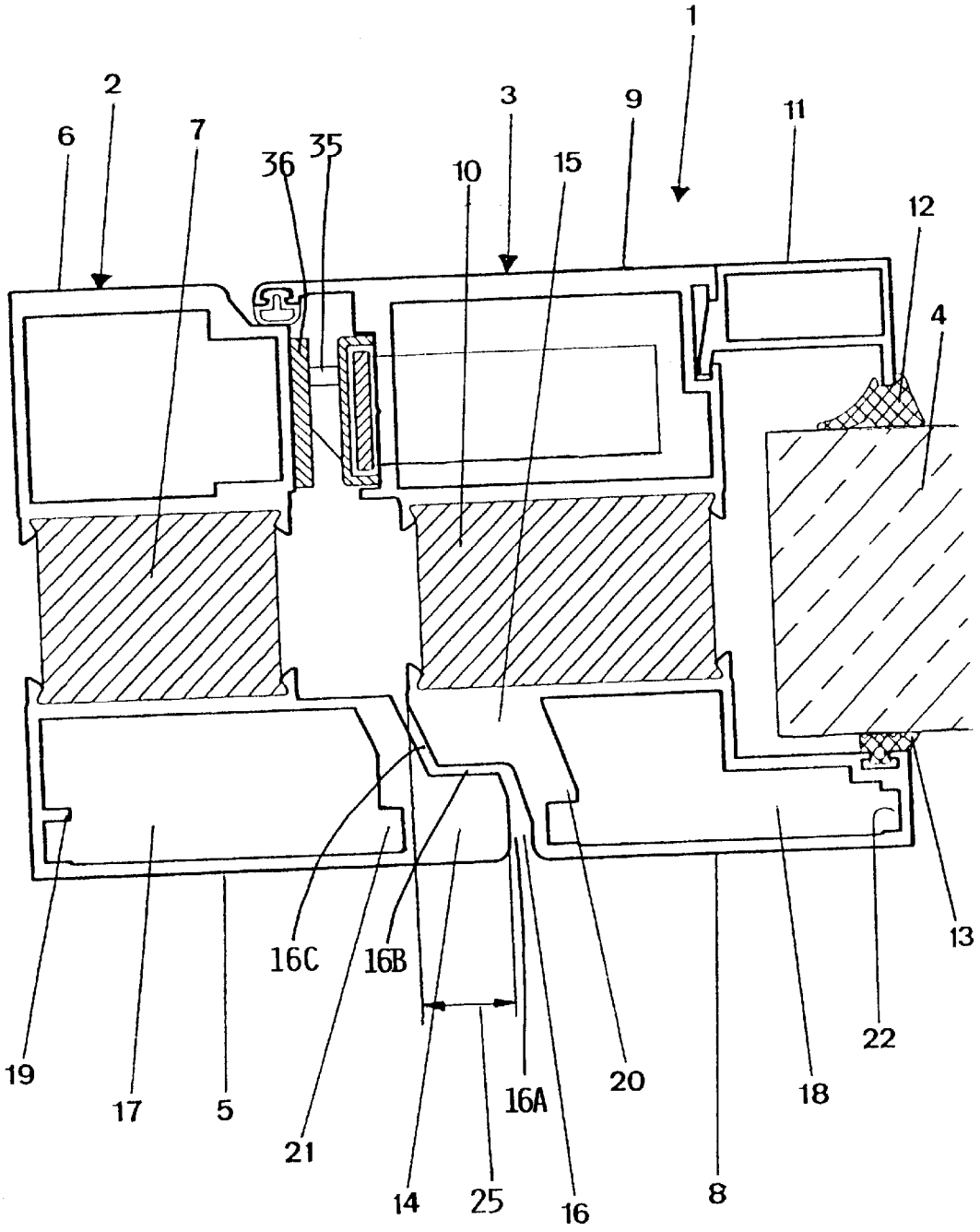
FIG. 1 shows a cross-section through the jamb frame and the door panel frame of a security door according to the invention.

FIG. 1 shows a cross-section of the frame area of a security structure, e.g. a security door or a security window, that protects and selectively opens or closes an opening in a wall of a building for example, or any other structure which may typically have a door or window or access hatch. Although a door is shown and discussed in the following embodiments, it should be understood that the same disclosure applies to a window, an access hatch or the like.

In the embodiment shown in FIG. 1, the structure is a security door 1 that has a door jamb frame 2 fixedly attached to a wall of a building along an edge of the wall bounding a door opening, and a door panel frame 3 that is pivotably mounted in the door jamb frame 2. The door panel frame 3 is provided with a filler panel 4 such as a safety glass plate or a non-transparent panel with comparable safety properties. The building wall itself is not shown, but is located directly to the left of the illustrated jamb frame 2, which is secured to the wall by screws or bolts or the like, which are also not shown. The frame area illustrated is the latch side frame construction, including a latch 35 mounted in the door panel frame 3 and a strike plate 36 mounted in or on the jamb frame 2, but these latching components are not significant to the invention and can have any conventional construction. The hinge side frame construction is similar (e.g. mirror-symmetrical) to the illustrated latch side frame construction, except for the provision of hinges instead of the latch components. Also, the frame construction at the top of the door 1, i.e. the top rail, can also be similar to the illustrated latch side frame construction forming the door latch stile, but without the latch components.

The door jamb frame 2 comprises a first outer hollow profile member 5 and a first inner hollow profile member 6 that are connected to each other by a first thermal insulation profile member 7. In an alternative embodiment, the first thermal insulation profile member 7 can be constructed as two isolating bridges or spacers with an insulating air chamber disposed between the respective hollow profile members 5, 6.

Similarly to the door jamb frame 2, the door panel frame or stile 3 comprises a second outer hollow profile member 8 and a second inner hollow profile member 9 that are connected to one another by a second thermal insulation profile member 10. The second inner hollow profile member 9 of the door panel frame 3 is also provided with a glass retaining strip 11 and a seal strip 12 made of elastic material which together retain and support the filler panel 4. The opposite outer side of the filler panel 4 is supported by a seal profile member 13 which is held in a rim portion of the second outer hollow profile member 8 of the door panel frame 3. As shown in FIG. 1, the rim portion of the second outer hollow profile member 8 has therein a hollow chamber extension of a hollow chamber 18, and protrudes laterally so as to overlap a rim of the filler panel 4 and to cover a gap between the facing lateral edges of the filler panel 4 and the door panel frame 3. The main portion of the hollow profile member 8 is thicker than the rim portion, and terminates at a rabbet edge along which the lateral edge of the filler panel 4 is received. Throughout this disclosure, the term "outer" refers to the side of the door subject to a forceful attack that is to be impeded, while the term "inner" refers to the side of the door facing the secured space.

On the outer side or the attack side of the door 1, a first edge portion 14 of the first hollow profile member 5 overlaps a second edge portion 15 of the second hollow profile member 8. Both edge portions 14, 15 are embodied as solid aluminum strips that are each about half (e.g. 40 to 60%) as thick as the maximum thickness of the respective profile member. Each hollow profile member 5, 8 is integrally manufactured as a single piece that includes the respective edge portion 14, 15 and the hollow portion enclosing a respective hollow chamber 17, 18 to be discussed below. A gap 16 is formed between the hollow profile members 5, 8 in the area 25 of the overlapping of the respective edge portions 14, 15. A first gap section 16A of the gap 16 runs initially at a right angle to the plane of the filler panel 4; a middle gap section 16B then extends parallel to the plane of the filler panel 4; and a final gap section 16C then extends diagonally or obliquely relative to the plane of the filler panel 4.

The solid edge portions 14, 15 make it very difficult for the door panel frame 3 to be pried open or broken open away from the jamb frame 2 using a pry bar or other tool, and they eliminate the possibility of a bullet or other projectile penetrating through the door 1 in the overlap area 25.

A respective hollow chamber 17, 18 is provided inside the respective hollow profile member 5, 8 as mentioned above. A laterally projecting first protrusion 19 and second protrusion 20, and a first recess 21 and a second recess 22 are profiled in the respective hollow chambers 17, 18 as shown in FIG. 1. The respective protrusions 19, 20 with the respective recesses 21, 22 provide a seating for receiving and retaining band-like or plate-shaped inserts that have a rectangular cross-section and that are disposed in the respective hollow chambers 17, 18. The respective protrusions or noses 19, 20 and recesses 21, 22 divide the respective hollow chambers 17, 18 into two sections, i.e. a first section that faces the attack side and a second section facing away from the attack side.

The security door 1 shown in FIG. 1, with the solid edge portions 14, 15 of the respective profile members 5, 8, satisfies the requirements in the low resistance classes for preventing a forced entry, without the addition of any inserts in the respective hollow chambers 17, 18, i.e. with the hollow chambers 17, 18 remaining hollow.

Figure 2:
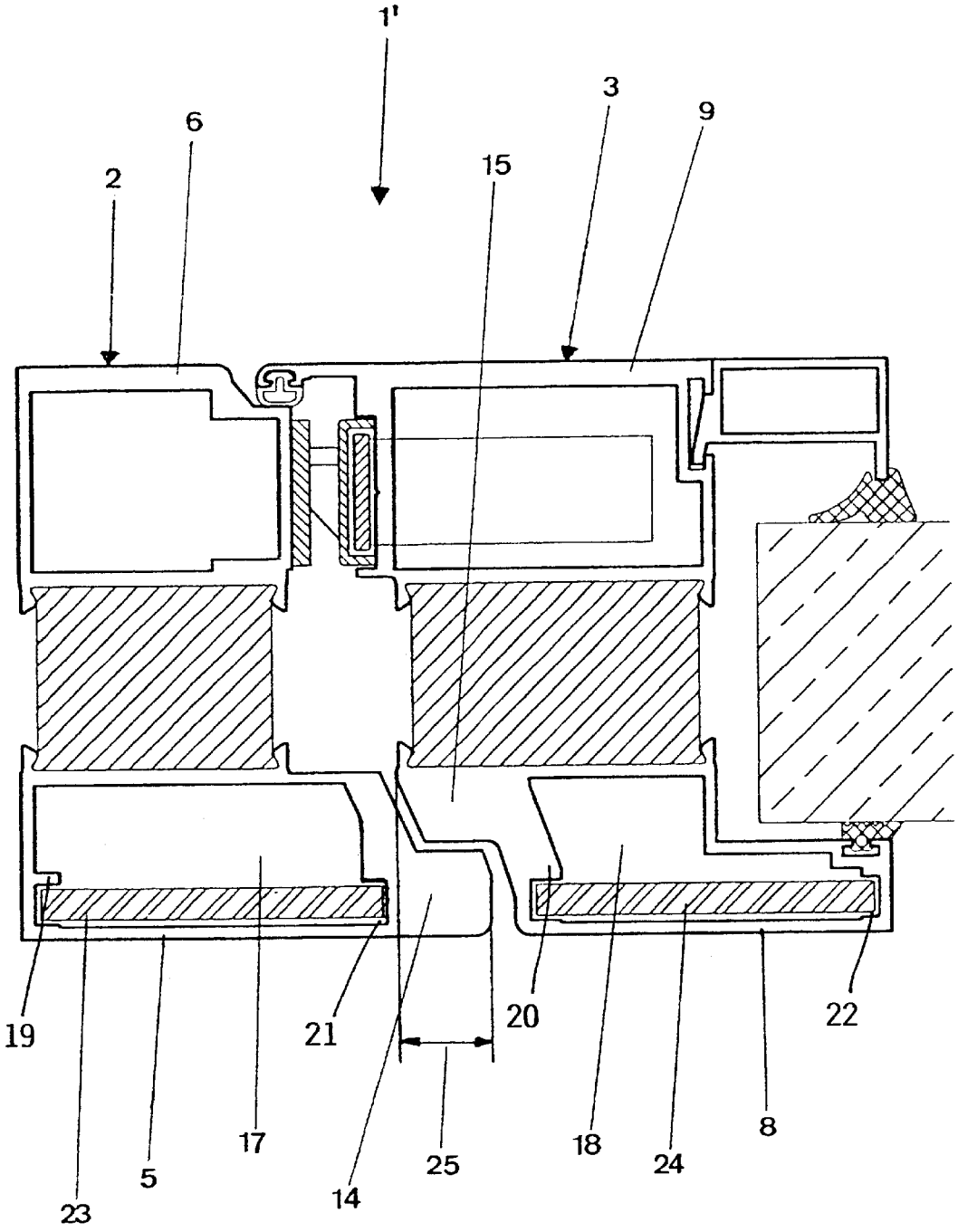
FIG. 2 shows the cross-section of the security door of FIG. 1, but with security inserts disposed respectively in the jamb frame profile member and the door panel frame profile member.

FIG. 2 shows a security door 1' that is based on the security door 1 shown in FIG. 1, but that has been modified to satisfy higher security requirements to protect against forced entry and penetration by projectiles. The overall construction of the door incorporates or corresponds to the construction described above with reference to FIG.1, whereby common reference numbers are used for the corresponding components in FIG.2, while a redundant description is omitted here.

As can be seen further in FIG. 2, a first insert 23 and a second insert 24 have been inserted respectively into the first hollow profile member 5 of the jamb frame 2 and the second hollow profile member 8 of the panel frame 3. These inserts 23, 24 are arranged in the respective hollow chambers 17, 18 so as to be retained respectively between the protrusion 19 and the recess 21 or between exclusively laterally next to an overlap area 25 formed by the overlapping respective solid edge portions 14, 15 of the respective hollow profile members 5, 8. In other words, the hollow chambers 17, 18 do not extend into the overlap area 25. Rather, the hollow profile members 5, 8 are respectively provided with the solid edge portions 14, 15 in the overlap area 25. This provides for a much simpler construction of the respective hollow profile members 5, 8 in the overlap area 25. Although the hollow profile members 5, 8 with the respective solid edge portions 14, 15 require somewhat more material than conventional entirely-hollow profile members, this cost is offset by the reduced manufacturing costs due to the simpler construction.

In a bullet-impeding embodiment, the solid edge portions 14, 15 of the profile members 5, 8 are directly adjacent to and abut against the edges of the respective inserts 23, 24 that are disposed in the respective hollow chambers 17, 18, in order to prevent the penetration of projectiles in the area between the inserts 23, 24 and the respective solid edge portions 14, 15.

The security properties of the security door 1, 1', with respect to both protecting against forced entry and penetration by a bullet or other projectile, can be adapted to meet any safety requirement by using the appropriate material for the inserts 23, 24 (e.g. steel, aluminum, ceramic, composites, synthetics such as Kevlar™, etc.). Moreover, each insert 23, 24 may include plural layers of different materials to achieve the required type and degree of security. Also, additional inserts can be arranged in the remaining portion of the hollow chamber 17, 18 directed away from the attack-prone outer side. Thus, the security door 1' according to the invention can satisfy the requirements of the highest resistance or security classes with regard to providing protection against forced entry and penetration by projectiles.

Figure 3:
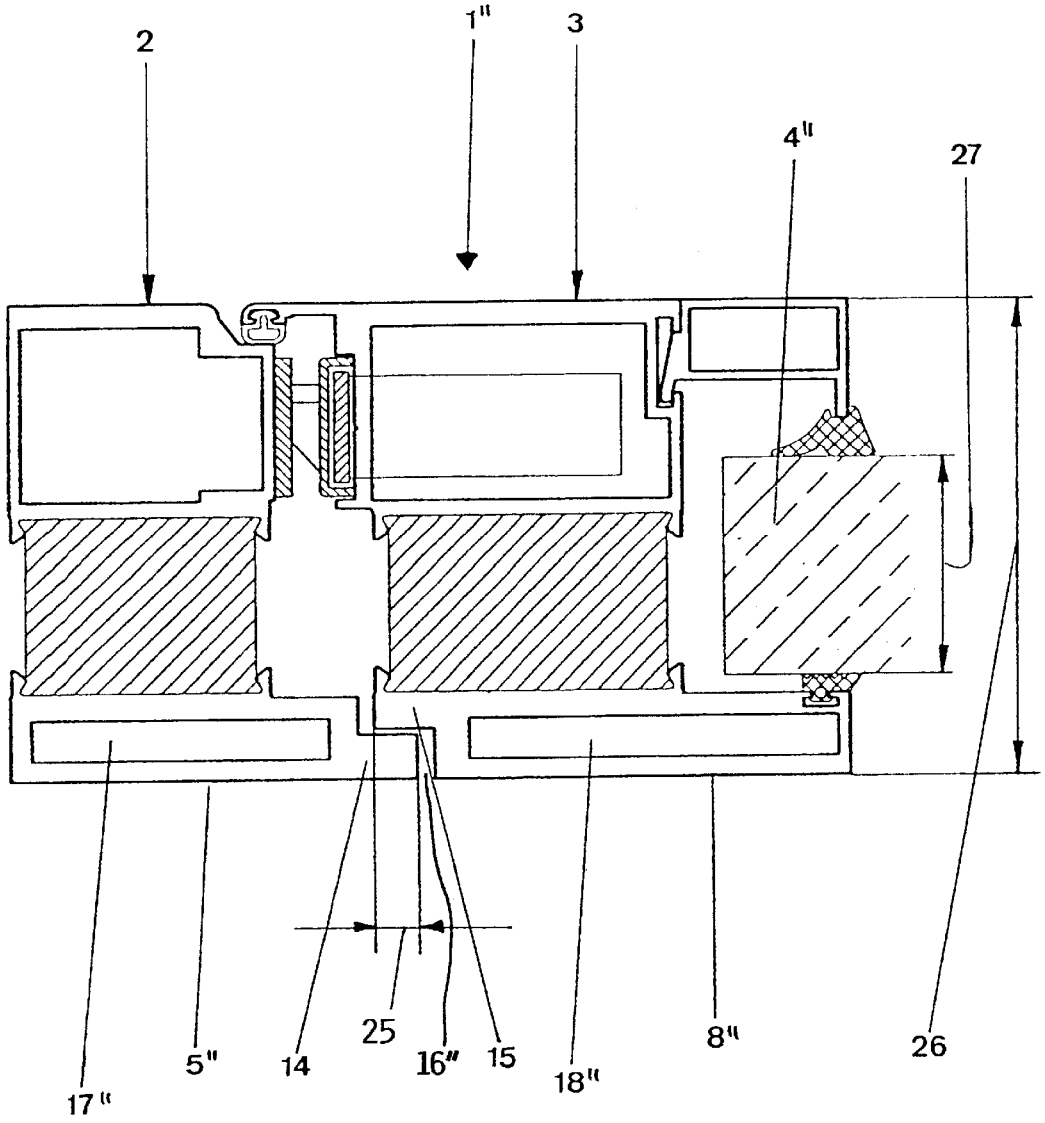
FIG. 3 shows a cross-section through the jamb frame and the door panel frame of an alternative embodiment of a security door according to the invention.

FIG. 3 shows as an alternative embodiment a security door 1", having a structure that generally corresponds to that of the door 1 of FIG. 1, whereby similar components of the present door 1" are labelled with common reference numbers that are further supplemented with a double prime mark (") when there is a difference in the component relative to FIG. 1. Respective hollow profile members 5" and 8" have therein respective flat hollow chambers 17" and 18" that each have a rectangular cross-section. In this embodiment, a construction depth or thickness 26 of the security door 1" can be reduced, especially if a thickness 27 of the filler panel 4" can be reduced for the particular application. Also note that the gap 16" includes only gap sections that extend either parallel to or perpendicular to the plane of the filler panel 4", in contrast to the above described gap 16 including the oblique gap section 16C.

Figure 4:
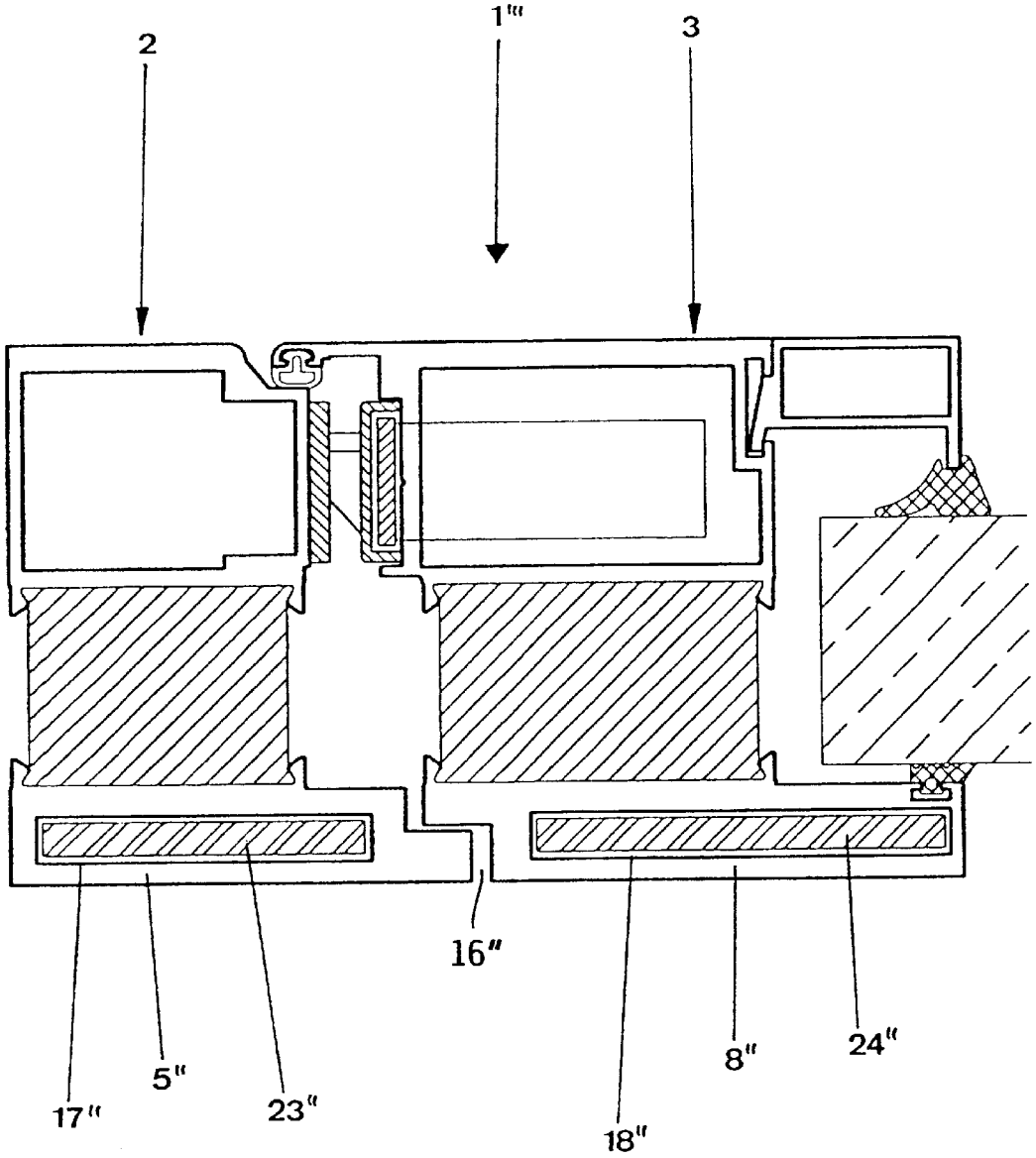
FIG. 4 shows the cross-section of the door of FIG. 3, but with security inserts disposed respectively in the jamb frame profile member and the door panel frame profile member.

FIG. 4 shows a door 1'" that corresponds essentially to the door 1" according to FIG. 3, except that inserts 23", 24" have been inserted into the respective hollow chambers 17", 18" of the respective hollow profile members 5", 8". Note that the inserts 23", 24" substantially fill the entirety of the hollow chambers 17", 18" as shown in FIG. 4, for example leaving enough clearance space so that the inserts can be slidingly inserted into the chambers, but also providing a friction fit in at least one dimension. The inserts 23", 24" provide the necessary protection to satisfy higher security requirements for protection against forced entry and/or penetration by a projectile through the safety door 1'".

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed:

1. A security structure for selectively closing and protecting an opening in a wall against at least one of forced entry and penetration by projectiles, said security structure comprising:

a jamb frame that is adapted to be secured to said wall, and that comprises a first hollow profile member including a first hollow portion with a first hollow chamber therein that extends longitudinally along said first hollow profile member, and including a first edge portion that extends longitudinally along said first hollow profile member directly adjacent to said first hollow chamber in said first hollow portion;

a movable panel frame that is movably connected to said jamb frame, and that comprises a second hollow profile member including a second hollow portion with a second hollow chamber therein that extends longitudinally along said second hollow profile member, a second edge portion that extends longitudinally along and protrudes from said second hollow portion directly adjacent to said second hollow chamber in said second hollow portion, and a rim portion that extends longitudinally along and protrudes from said second hollow portion opposite from said second edge portion;

a filler panel held and supported by said panel frame with a lateral edge of said filler panel facing and adjacent to a lateral edge of said panel frame;

wherein:

said first edge portion and said second edge portion mutually overlap each other in an overlap area when said panel frame is in a closed position relative to said jamb frame;

at least one of said first edge portion and said second edge portion is a solid edge portion consisting of a solid material without a hollow space therein;

said first and second hollow chambers are located exclusively laterally next to said overlap area and do not extend into said overlap area;

said rim portion comprises a hollow rim portion having therein a hollow chamber extension that communicates and extends continuously from said second hollow chamber in said second hollow portion;

said hollow rim portion extends integrally from said second hollow portion;

said hollow rim portion with said hollow chamber extension therein protrudes from said second hollow portion beyond said lateral edge of said panel frame and overlaps a rim of said filler panel adjoining said lateral edge of said filler panel; and said first edge portion, said second edge portion and said rim portion are provided on a side of said security structure that is subject to forced entry or penetration by projectiles.

2. The security structure according to claim 1, wherein both said first edge portion and said second edge portion are respectively said solid edge portions respectively consisting of said solid material without a hollow space therein.

3. The security structure according to claim 1, wherein said first hollow profile member is a first integral one-piece member including said first hollow portion and said first edge portion integrally formed and adjoining each other, and said second hollow profile member is a second integral one-piece member including said second hollow portion, said second edge portion, and said rim portion integrally formed and adjoining each other.

4. The security structure according to claim 3, wherein said first edge portion is 40% to 60% as thick as said first hollow portion in a thickness direction perpendicular to a major plane along which major dimensions of said security structure extend, and said second edge portion is 40% to 60% as thick as said second hollow portion in said thickness direction.

5. The security structure according to claim 1, wherein a gap is formed between said first hollow profile member and said second hollow profile member in said overlap area when said panel frame is in said closed position relative to said jamb frame, said jamb frame and said panel frame each respectively include an outer side and an inner side facing opposite each other, said outer side is said side that is subject to forced entry or penetration by projectiles, said security structure has major dimensions that extend along a major plane, said gap includes a first gap section, a second gap section and a third gap section sequentially in communication with each other from said outer side to said inner side, said first gap section extends substantially perpendicular to said major plane, said second gap section extends substantially parallel to said major plane, and said third gap section extends at an oblique angle relative to said major plane.

6. The security structure according to claim 1, wherein a gap is formed between said first hollow profile member and said second hollow profile member in said overlap area when said panel frame is in said closed position relative to said jamb frame, said jamb frame and said panel frame each respectively include an outer side and an inner side facing opposite each other, said outer side is said side that is subject to forced entry or penetration by projectiles, said security structure has major dimensions that extend along a major plane, said gap includes a first gap section, a second gap section and a third gap section sequentially in communication with each other from said outer side to said inner side, said first gap section extends substantially perpendicular to said major plane, said second gap section extends substantially parallel to said major plane, and said third gap section extends substantially perpendicular to said major plane.

7. The security structure according to claim 1, wherein at least a respective one of said hollow profile members includes structural features that divide said hollow chamber in said respective hollow profile member into a first subchamber adjacent to an outer exposed side of said respective hollow profile member and a second subchamber adjacent to said first subchamber on a side opposite said outer exposed side of said respective hollow profile member.

8. The security structure according to claim 1, wherein said first hollow profile member is a first outer profile member, and wherein said jamb frame further comprises a hollow first inner profile member and a first thermal insulation member that is arranged between and interconnects said first inner profile member and said first outer profile member.

9. The security structure according to claim 1, wherein said second hollow profile member is a second outer profile member, and wherein said panel frame further comprises a hollow second inner profile member and a second thermal insulation member that is arranged between and interconnects said second inner profile member and said second outer profile member.

10. The security structure according to claim 1, wherein said movable panel frame is pivotably connected to said jamb frame to be pivotable away from said jamb frame in a direction away from said side that is subject to forced entry or penetration by projectiles.

11. The security structure according to claim 1, wherein said second hollow portion is thicker than said rim portion in a thickness direction perpendicular to a major plane along which major dimensions of said security structure extend, and said second hollow portion has a rabbet edge adjoining said rim portion, wherein said rabbet edge extends along, faces and is adjacent to said lateral edge of said filler panel and forms at least a part of said lateral edge of said panel frame.

12. The security structure according to claim 1, wherein a lateral clearance is formed between said jamb frame and said panel frame, and wherein said hollow chamber of at least one of said first and second hollow portions protrudes laterally beyond said lateral clearance to extend in front of said lateral clearance as seen in a direction from said side that is subject to forced entry or penetration by projectiles.

13. The security structure according to claim 1, wherein said hollow profile members respectively consist essentially of a metal.

14. A security structure for protecting an opening in a wall, said security structure comprising:

a jamb frame that is adapted to be secured to said wall, and that comprises a first hollow profile member including a first hollow portion with a first hollow chamber therein that extends longitudinally along said first hollow profile member, and including a first edge portion that extends longitudinally along said first hollow profile member directly adjacent to said first hollow chamber in said first hollow portion; and a movable panel frame that is movably connected to said jamb frame, and that comprises a second hollow profile member including a second hollow portion with a second hollow chamber therein that extends longitudinally along said second hollow profile member, and including a second edge portion that extends longitudinally along said second hollow profile member directly adjacent to said second hollow chamber in said second hollow portion;

wherein:

said first edge portion and said second edge portion mutually overlap each other in an overlap area when said panel frame is in a closed position relative to said jamb frame;

at least one of said first edge portion and said second edge portion is a solid edge portion consisting of a solid material without a hollow space therein;

said first and second hollow chambers are located exclusively laterally next to said overlap area and do not extend into said overlap area;

at least a respective one of said hollow profile members includes structural features that divide said hollow chamber in said respective hollow profile member into a first subchamber adjacent to an outer exposed side of said respective hollow profile member and a second subchamber adjacent to said first subchamber on a side opposite said outer exposed side of said respective hollow profile member; and said structural features include a protruding ledge and a recessed channel, which do not entirely physically separate said first subchamber from said second subchamber, so that said first subchamber communicates with said second subchamber.

15. A security structure for protecting an opening in a wall, said security structure comprising:

a jamb frame that is adapted to be secured to said wall, and that comprises a first hollow profile member including a first hollow portion with a first hollow chamber therein that extends longitudinally along said first hollow profile member, and including a first edge portion that extends longitudinally along said first hollow profile member directly adjacent to said first hollow chamber in said first hollow portion;

a movable panel frame that is movably connected to said jamb frame, and that comprises a second hollow profile member including a second hollow portion with a second hollow chamber therein that extends longitudinally along said second hollow profile member, and including a second edge portion that extends longitudinally along said second hollow profile member directly adjacent to said second hollow chamber in said second hollow portion; and a security enhancing insert that is arranged in one of said hollow chambers in one of said hollow profile members, and that increases at least one of a strength and a projectile penetration resistance of said one hollow profile member in which said insert is arranged;

wherein:

said first edge portion and said second edge portion mutually overlap each other in an overlap area when said panel frame is in a closed position relative to said jamb frame;

at least one of said first edge portion and said second edge portion is a solid edge portion consisting of a solid material without a hollow space therein; and said first and second hollow chambers are located exclusively laterally next to said overlap area and do not extend into said overlap area.

16. The security structure according to claim 15, wherein said insert is a one-piece single layer insert.

17. The security structure according to claim 15, wherein said insert is a multilayer insert comprising a plurality of layers.

18. The security structure according to claim 17, wherein said layers respectively consist of different materials.

19. The security structure according to claim 15, wherein said insert essentially consists of at least one material selected from the group consisting of aluminum, aluminum alloys, steels, hardened metals, ceramics, composites, and synthetic materials.

20. The security structure according to claim 19, wherein said hollow profile members respectively consist essentially of a metal.

21. The security structure according to claim 15, wherein at least a respective one of said hollow profile members includes structural features that divide said hollow chamber in said respective hollow profile member into a first subchamber adjacent to an outer exposed side of said respective hollow profile member and a second subchamber adjacent to said first subchamber on a side opposite said outer exposed side of said respective hollow profile member, and wherein said security enhancing insert is arranged and retained in said first subchamber.

22. The security structure according to claim 21, wherein said insert abuts directly against said edge portion of said respective hollow profile member.

23. The security structure according to claim 21, wherein said second subchamber remains hollow.

24. The security structure according to claim 15, wherein a respective one of said hollow profile members includes only a single hollow space therein consisting of said respective hollow chamber in said respective hollow profile member, and said security enhancing insert is arranged in and substantially fills said respective hollow chamber.

* * * * *